US007121331B2

(12) United States Patent
Yoshida et al.

(10) Patent No.: US 7,121,331 B2
(45) Date of Patent: Oct. 17, 2006

(54) HEAT EXCHANGER

(75) Inventors: Kazue Yoshida, Sano (JP); Hidenobu Kameda, Tochigi (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/916,680

(22) Filed: Aug. 11, 2004

(65) Prior Publication Data

US 2005/0082048 A1 Apr. 21, 2005

(51) Int. Cl.
*F28F 3/00* (2006.01)
*F28F 13/12* (2006.01)

(52) U.S. Cl. ..... 165/166; 165/109.1; 165/170

(58) Field of Classification Search ..... 165/164–167, 165/152–153, 916, 170, 109.1
See application file for complete search history.

(56) References Cited

U.S. PATENT DOCUMENTS 2,360,123 A * 10/1944 Gerstung et al. ..... 165/298
4,653,581 A * 3/1987 Yogo et al. ..... 165/166
4,815,532 A * 3/1989 Sasaki et al. ..... 165/152
4,815,534 A * 3/1989 Fuerschbach ..... 165/67
5,720,341 A * 2/1998 Watanabe et al. ..... 165/135
6,206,089 B1 * 3/2001 Uchikawa et al. ..... 165/109.1
6,341,649 B1 * 1/2002 Joshi et al. ..... 165/153
2003/0164233 A1 * 9/2003 Wu et al. ..... 165/166
2004/0003916 A1 * 1/2004 Nash et al. ..... 165/153

FOREIGN PATENT DOCUMENTS

JP 2000-18848 1/2000
JP 2003097890 A * 4/2003

* cited by examiner

*Primary Examiner*—Tho Duong
(74) *Attorney, Agent, or Firm*—Brendo O. Holmes; Kilpatrick Stockton LLP

(57) ABSTRACT

A heat exchanger includes a plurality of plate-shaped heat exchanger units and a plurality of flat fins arranged on the units, respectively. Each of the units has a first planar fluid communication chamber for receiving the flat fin. The flat fin has a first end provided with a first recess and a second end opposing to the first end and provided with a second recess. The first recess includes a circular opening and a cutout part. The second recess includes a circular opening and a cutout part. A clearance is defined between an edge of the first end and an inner periphery of the chamber, while another clearance is defined between an edge of the second end and the inner periphery. Consequently, a fluid can flow along the edge of the first end after being introduced into the first planar fluid communication chamber through the first recess.

7 Claims, 8 Drawing Sheets

HEAT EXCHANGER

BACKGROUND OF THE INVENTION

1. Field of the Invention

The present invention relates to a heat exchanger which is available for an evaporator for an automotive air conditioner or the like.

2. Description of the Related Art

For this sort of heat exchanger, there is known a heat exchanger that includes a flat fluid communication chamber and a flat fin accommodated in the fluid communication chamber and having a configuration corresponding to the chamber. As shown in FIG. 1, the fin 101 has two opposing ends 101*a*, 101*b* provided with openings 102, 103, respectively. The heat exchanger is constructed so as to allow fluid to flow from the opening 102 toward the opening 103.

In the heat exchanger of this sort, there is a tendency that the fluid flows toward the center of the fin 101 in large quantity while the fluid flows toward the periphery of the fin 101 in small quantity since the flowing resistance of fluid in the direction X is smaller that in the direction Y. As a result, the heat exchanger has problems of a greater pressure loss and a smaller heat exchanger amount.

In order to solve these problems about the heat exchanger, Japanese Patent Application Laid-open No. 2000-18848 discloses a countermeasure as shown in FIG. 2. The fin 101 is provided, on both ends thereof, with openings 102, 103 each having auxiliary openings 104, 105 extending from the openings 102, 103 in the direction Y. Alternatively, the openings 102, 103 are modified to be either elliptical or rhomboidal thereby expanding in the direction Y.

Nevertheless, there still remains a problem that only small quantity of fluid flows into both ends of the fin 101, so that heat exchange is hardly carried out in these areas of the fin 101.

SUMMARY OF THE INVENTION

In the above-mentioned situation, it is an object of the present invention to provide a heat exchanger including a flat fin provided, at opposing ends thereof, with two recesses (opening or cutout part) allowing a fluid to flow from one recess to the other recess, the heat exchanger capable of improvement in heat exchange at the ends of the flat fin.

In order to attain the above object, according to the present invention, a heat exchanger comprises: a plate-shaped heat exchanger unit shaped to be substantially rectangular in plan view, the plate-shaped heat exchanger unit having a first planar fluid communication chamber defined therein; and a flat fin shaped similarly to the first planar fluid communication chamber and accommodated in the first planar fluid communication chamber, the flat fin having a first end provided with a first recess and a second end opposing to the first end and provided with a second recess, wherein the flat fin is shaped so as to defined a clearance between the first end and an inner periphery of the first planar fluid communication chamber, thereby allowing a first fluid, which has been introduced into the first planar fluid communication chamber through the first recess, to flow along an edge of the first end.

In the present invention, owing to the provision of the clearance between the first end and the inner periphery of the first planar fluid communication chamber, the first fluid partially flows from the first recess to the edge of the first end of the flat fin. Thus, the heat exchange can be promoted in the vicinity of the first end, whereby the heat exchanging efficiency can be improved.

According to a preferred embodiment of the present invention, the flat fin is shaped so as to define another clearance between the second end and the inner periphery of the first planar fluid communication chamber.

Then, owing to the provision of the above clearance between the second end and the inner periphery of the first planar fluid communication chamber, the first fluid further flows along the edge of the second end of the flat fin and toward the second recess. Thus, the heat exchange can be promoted in the vicinity of the second end, whereby the heat exchanging efficiency can be improved.

According to the embodiment, the plate-shaped heat exchanger unit is provided with a first communication hole in communication with the first recess of the flat fin and a second communication hole in communication with the second recess of the flat fin.

In the heat exchanger having a plurality of plate-shaped heat exchanger units in lamination, owing to the provision of the first communication hole, it becomes possible to diverge the first fluid into respective first planar fluid communication chambers of the units.

According to the embodiment, the first communication hole and the second communication hole are arranged at two diagonal corners of the plate-shaped heat exchanger unit, respectively.

Then, the above arrangement of the first communication hole and the second communication hole allows the first fluid to flow from the first recess to the second recess through the whole area of the fin.

According to the embodiment, a shape of the first recess is substantially identical to a shape of the second recess.

In this case, owing to the identification of the first recess and the second recess in shape, the shape of the fin can be simplified to save its manufacturing cost.

According to the embodiment, the first recess comprises a first circular opening formed in the vicinity of the edge of the first end and a first cutout part formed to communicate the first circular opening with the edge of the first end, and the second recess comprises a second circular opening formed in the vicinity of the edge of the second end and a second cutout part formed to communicate the second circular opening with the edge of the second end.

According to the embodiment, the first cutout part has its width substantially equal to a diameter of the first circular opening, while the second cutout part has its width substantially equal to a diameter of the second circular opening.

In this case, owing to the formation of the first and second cutout parts, the flowing resistance of the first fluid can be reduced to decrease the pressure drop in the first planar fluid communication chamber.

According to the embodiment, the first recess is a first circular opening formed so that its part intersects with the edge of the first end of the flat fin, while the second recess is a second circular opening formed so that its part intersects with an edge of the second end of the flat fin.

Due to simplicity in shape of the first and second recesses, it is possible to save the manufacturing cost of the fin.

According to the embodiment, the plate-shaped heat exchanger unit has a second planar fluid communication chamber defined therein for a second fluid different from the first fluid.

In this case, the heat exchange between the first fluid flowing in the first planar fluid communication chamber and the second fluid flowing in the second planar fluid communication chamber can be accomplished.

These and other objects and features of the present invention will become more fully apparent from the following description and appended claims taken in conjunction with the accompany drawings.

DETAILED DESCRIPTION OF THE PREFERRED EMBODIMENT

Referring to accompanying drawings, an embodiment of the present invention will be described below.

Figure 1:
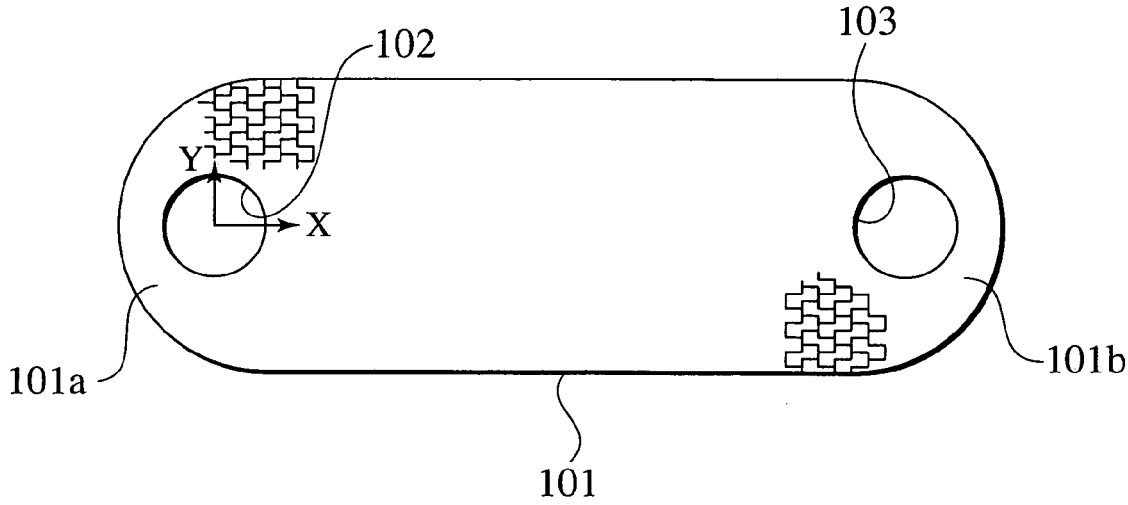
FIG.1 PRIOR ART
FIG. 1 is a plan view of a fin for a conventional heat exchanger in the related art.
Figure 2:
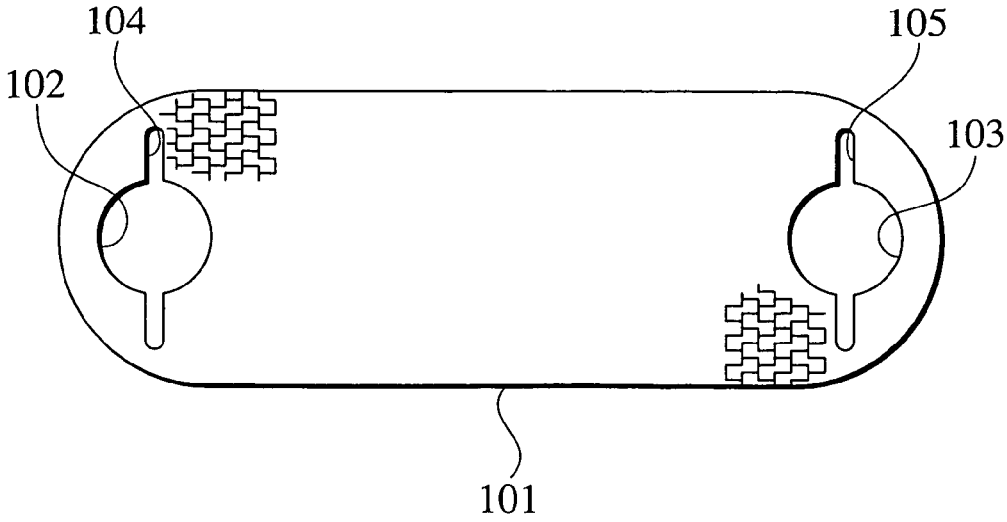
FIG.2 PRIOR ART
FIG. 2 is a plan view of another fin for a conventional heat exchanger in the related art.
Figure 3:
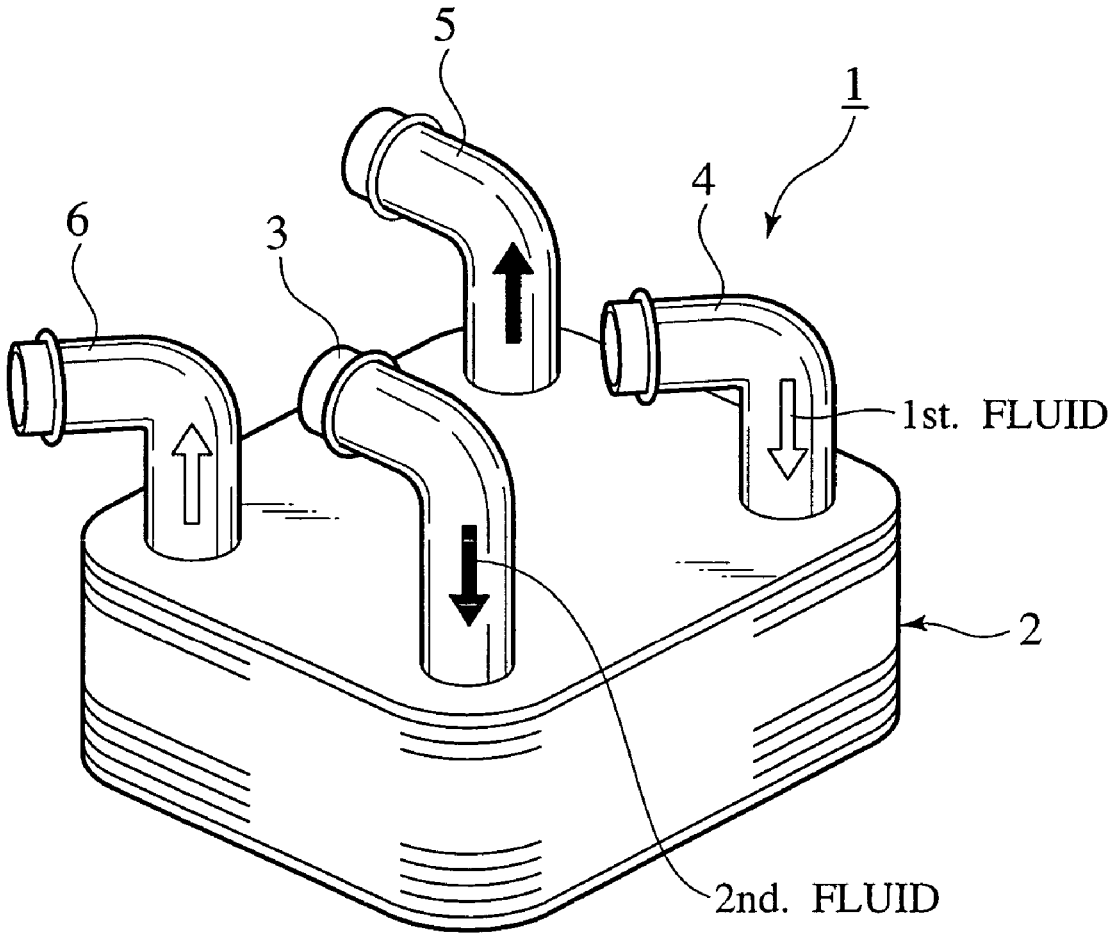
FIG. 3 is an overall perspective view of a heat exchanger of an embodiment according to the present invention.

FIG. 3 is an overall perspective view of a heat exchanger 1 in accordance with the embodiment. The heat exchanger 1 includes a core part 2, two (first and second) inlet pipes 3, 4 for introducing fluid into the core part 2 and two (first and second) outlet pipes 5, 6 for discharging the fluid from the core part 2.

Figure 4:
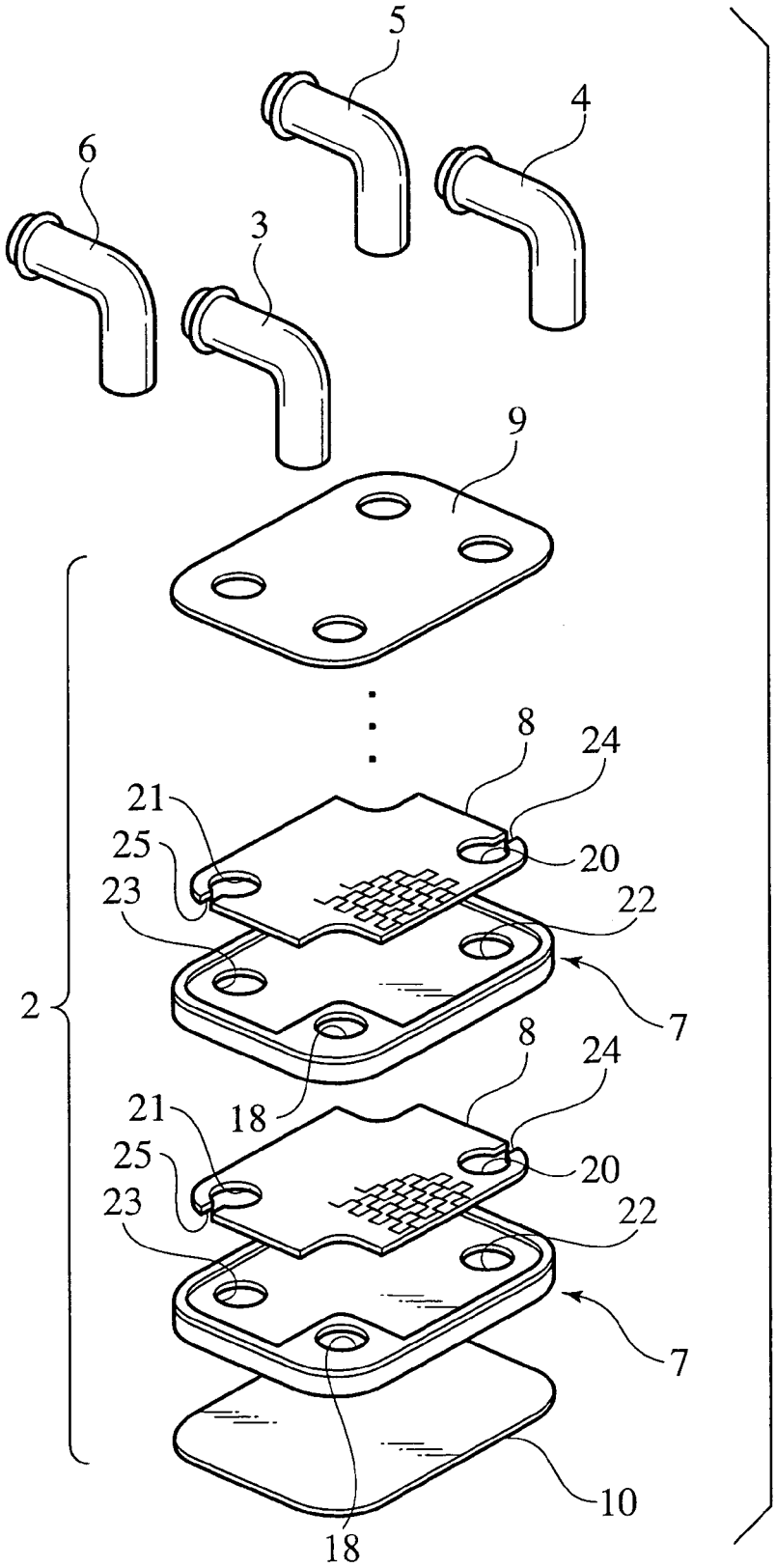
FIG. 4 is an exploded perspective view of the heat exchanger of FIG. 3.

FIG. 4 is an exploded perspective view of the heat exchanger 1. The core part 2 has a plurality of plate-shaped heat exchanger units 7 laminated vertically, a plurality of flat fins 8 each arranged on the heat exchanger units 7, an upper side plate 9 arranged on the uppermost heat exchanger unit 7 and a lower side plate 10 arranged below the lowermost heat exchanger unit 7.

Figure 5:
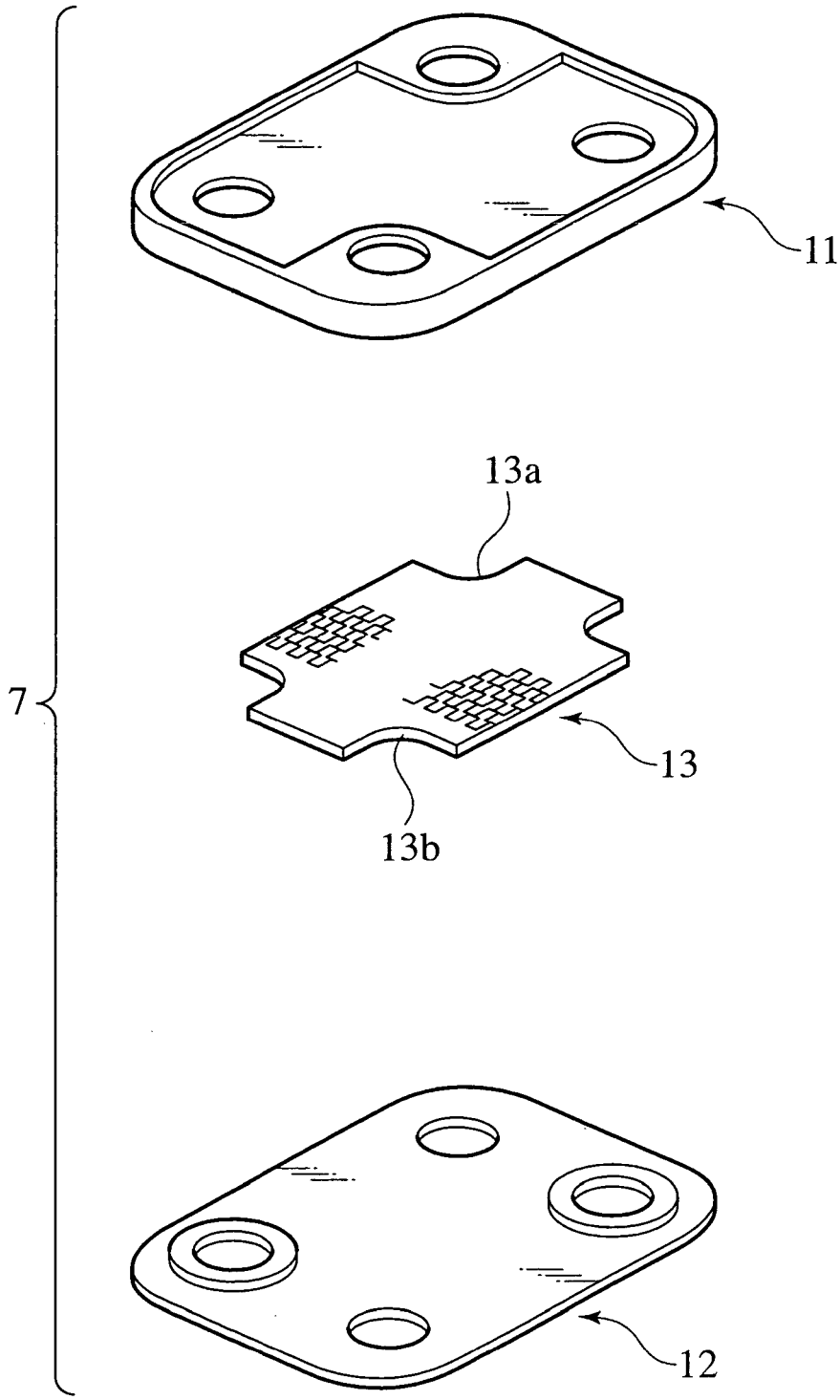
FIG. 5 is an exploded perspective view of a heat exchanger unit forming the heat exchanger of FIG. 3.

FIG. 5 is an exploded perspective view of one heat exchanger unit 7. As shown in FIG. 5, the heat exchanger unit 7 includes a first tube sheet 11 and a second tube sheet 12 overlapped on each other and each shaped to be substantially flat and rectangular and a flat fin 13 interposed between the first tube sheet 11 and the second tube sheet 12.

Figure 6:
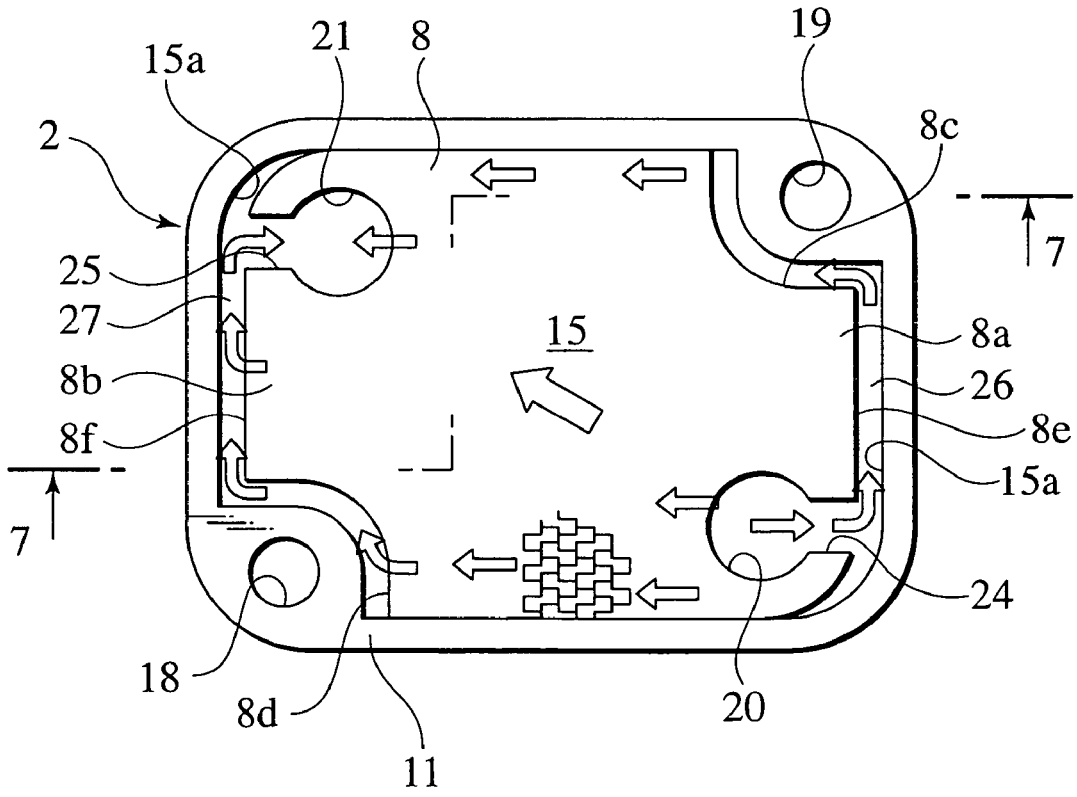
FIG. 6 is a plan view of a core part of the heat exchanger of FIG. 3 excluding an upper side plate of FIG. 4.
Figure 7:
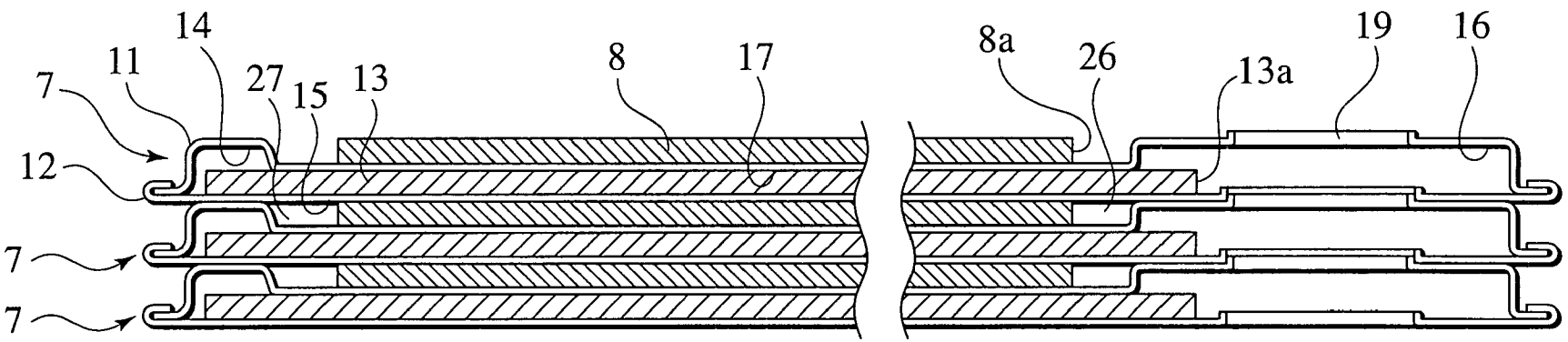
FIG. 7 is a sectional view of the core part, taken along a line 7—7 of FIG. 6.

FIG. 6 is a plan view of the core part 2 but the upper side plate 9. FIG. 7 is a sectional view taken along a line 7—7 of FIG. 6.

As shown in FIG. 7, a second fluid communication chamber 14 and a first fluid communication chamber 15 are alternately formed between each of the first tube sheets 11 and each of the second tube sheets 12 in lamination. Noted that the first fluid communication chamber 15 is defined also between the uppermost tube sheet 11 and the upper side plate 9.

The fluid communication chamber 14 is flat and includes an inlet header chamber (not shown) arranged at one corner of a square in top view, an outlet header chamber 16 arranged at a diagonal corner to the inlet header chamber and a heat exchanger chamber 17 communicating the inlet header chamber with the outlet header chamber 16. The inlet header chamber has the same structure as that of the outlet header chamber 16. Both of the inlet header chamber and the outlet header chamber 16 have respective bottom surfaces in level with the bottom surface of the heat exchanger chamber 17, while respective top surfaces of both chambers are established higher than the top surface of the heat exchanger chamber 17.

The inlet header chamber of the fluid communication chamber 14 is communicated with the adjoining inlet header chamber of the fluid communication chamber 14 through a communication hole 18 (see FIG. 4), while the outlet header chamber 16 is communicated with the adjoining outlet header chamber 16 through a communication hole 19. The first inlet pipe 3 and the first outlet pipe 5 are respectively connected with the so-communicated fluid communication chambers 14 so that the first inlet pipe 3 opposes the inlet header chambers, while the first outlet pipe 5 opposes the outlet header chambers 16.

On the other hand, the fluid communication chamber 15 is communicated with the adjoining fluid communication chamber 15 through openings 20, 21 (see FIG. 4) formed at opposing corners of the fin 8 and first and second communication holes 22, 23 (see FIG. 4) formed at opposing corners of the heat exchanger unit 7. The second inlet pipe 4 and the second outlet pipe 6 are respectively connected with the so-communicated fluid communication chambers 15 so that the second inlet pipe 3 opposes the first communication hole 22 on the inlet side of the chambers 15, while the second outlet pipe 6 opposes the second communication hole 23 on the outlet side of the chambers 15.

Both of the fins 8, 13 are formed by elements allowing the fluid to flow from the inlet chamber to the outlet chamber 16, for example, so-called offset fins.

As shown in FIG. 5, the fin 13 is basically shaped to be a rectangular plane member having dimensions substantially equal to those of the fluid communication chamber 14. Different from the chamber 14, however, such a rectangular plane member has its four corners cut away in arcs. In detail, as shown in FIG. 7, the fin 13 is arranged so that its side edge 13*a* describing an arc projects into the outlet header chamber 16, while another side edge 13*b* projects into the inlet header chamber (not shown).

On the other hand, the fin 8 is shaped to be rectangular of dimensions substantially equal to those of the fluid communication chamber 15, basically. Different from the fluid communication chamber 15, however, two opposing ends 8*a*, 8*b* of the fin 8 are cut away so as to describe arcs at the corner close to the outlet header chamber 16 and also at the corner close to the inlet header chamber. Additionally, the fin 8 is provided, at two other diagonal corners thereof, with first and second circular openings 20, 21, respectively. In detail, the fin 8 is arranged so that its arc side edge 8*c* (see FIG. 6) opposes the outside surface of the outlet header chamber 16, while another arc side edge 8*d* (see FIG. 6) opposes the outside surface of the inlet header chamber.

According to the embodiment, as shown in FIG. 6, the fin 8 has a first cutout part 24 formed at the corner of the first end 8*a* having the opening 20 to extend from the opening 20 to an edge 8*e* of the first end 8*a*. Additionally, the fin 8 has a second cutout part 25 formed at the corner of the second end 8*b* having the other opening 21 to extend from the opening 21 to an edge 8*f* of the second end 8*b*. Noted that both of the first circular opening 20 and the first cutout part 24 are defined as the first recess of the invention, while both of the second circular opening 21 and the second cutout part 25 are defined as the second recess of the invention Further, a clearance 26 is defined between the edge 8*e* of the fin 8 and the inner periphery 15*a* of the fluid communication passage 15 and another clearance 27 is defined between the edge 8*f* of the fin 8 and the inner periphery 15*a* of the fluid communication passage 15. The clearance 26 extends between the side edge 8*c* and the outside surface of the outlet header chamber 16 so that the fluid flow from the opening 20 flows to the edge 8*e* and the side edge 82 through the clearance 26. The clearance 27 extends between the side edge 8*d* and the outside surface of the inlet header chamber so that the fluid flow from the edge 8*f* and the side edge 8*d* to the opening through the clearance 27.

In the above-mentioned structure, the first fluid inflowing via the first inlet pipe 3 diverges into the respective fluid communication chambers 14. Subsequently, the first fluid converges and outflows to the outside of the chambers 14 through the first outlet pipe 5. On the other hand, the second fluid inflowing via the second inlet pipe 4 diverges into the respective fluid communication chambers 15. After flowing in the chambers 15 in a manner shown with outline arrows in FIG. 6, the so-divided second fluid converges again and outflows to the outside of the chambers 15 through the second outlet pipe 6. During such flows in the chambers 14, 15, heat exchange is accomplished between the first fluid and the second fluid.

According to the present invention, in each of the fluid communication chambers 15, some part of the fluid flows from the opening 20 toward the opening 21 directly, while the other part of the fluid flows into the clearance 26 through the cutout part 24 and subsequently flows toward the opening 21. Further, some part of the fluid passing through the fin 8 flows into the opening 21 directly, while the other part of the fluid flows into the cutout part 25 via the clearance 27 and finally flows into the opening 21. That is, according to the invention, since the provision of the clearances 26, 27 allows the fluid to flow toward both ends 8*a*, 8*b* of the fin 8, the heat exchange can be carried out throughout the fin 8 with high efficiency.

Additionally, since it is possible to make the fluid flow along the edges 8*e*, 8*f* of the fin 8 due to the presence of the clearances 26, 27, the heat exchanger can provided with desired heat exchanging performance. Further, since the flowing resistance of the fluid is reduced by the clearances 26, 27, the heat exchanger has an advantage of reduced pressure drop.

FIGS. 8 to 11 show various modifications of the fin 8. In these modifications, also a clearance 26 is defined between the edge 8*e* of the fin 8 and the inner periphery 15*a* of the fluid communication passage 15 and another clearance 27 is defined between the edge 8*f* of the fin 8 and the inner periphery 15*a* of the fluid communication passage 15.

Figure 8:
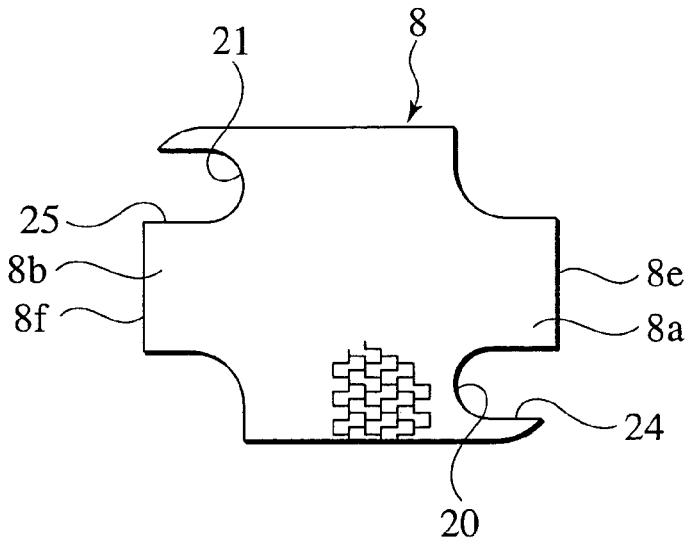
FIG. 8 is a plan view of a fin in the first modification of the embodiment.
Figure 9:
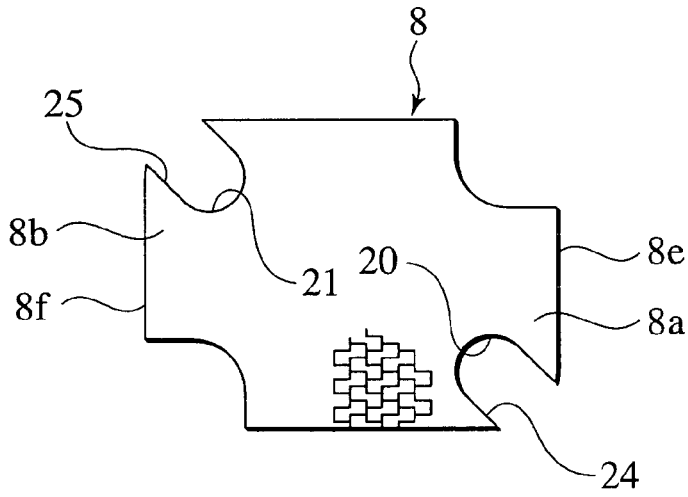
FIG. 9 is a plan view of a fin in the second modification of the embodiment.

In common with the modifications of FIGS. 8 and 9, the cutout parts 24, 25 are formed so that their widths are equal to diameters of the openings 20, 21, respectively. Owing to the above formation of the cutout parts 24, 25, it is possible to reduce the flowing resistance of the fluid, whereby the pressure drop in the chambers 15 can be reduced.

Figure 10:
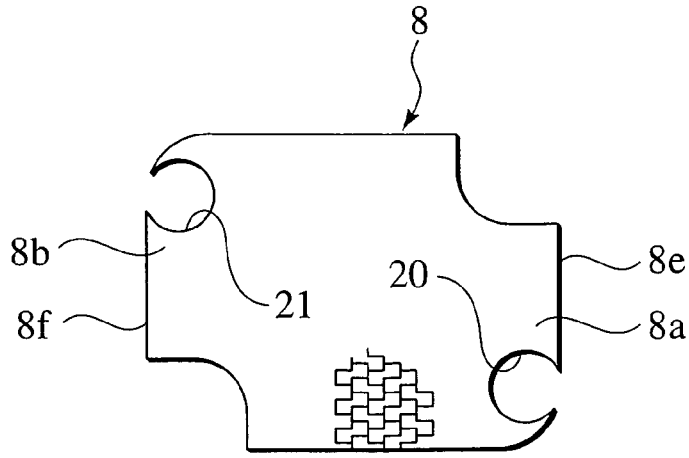
FIG. 10 is a plan view of a fin in the third modification of the embodiment.

In the modification of FIG. 10, excluding the above cutout parts, the openings 20, 21 are arranged so that their parts intersect with the edges 8*e*, 8*f* of the fin 8.

Figure 11:
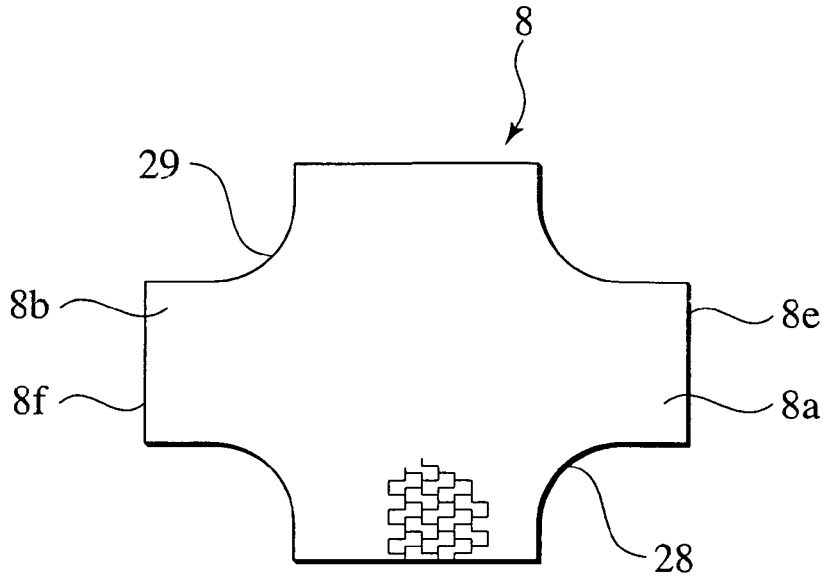
FIG. 11 is a plan view of a fin in the fourth modification of the embodiment.

In the modification of FIG. 11, the fin 8 is provided, at two corners thereof, with arc-shaped recesses 28, 29 in place of the above openings 20, 21. These recesses 28, 29 are formed in a manner that some part of the fluid flows from the recess 28 toward the recess 29 directly and the other part of the fluid flows the recess 28, the edges 8*e*, 8*f* and the recess 29, in order. The operation and effects are similar to those of the fin 8 shown in FIG. 6.

Figure 12:
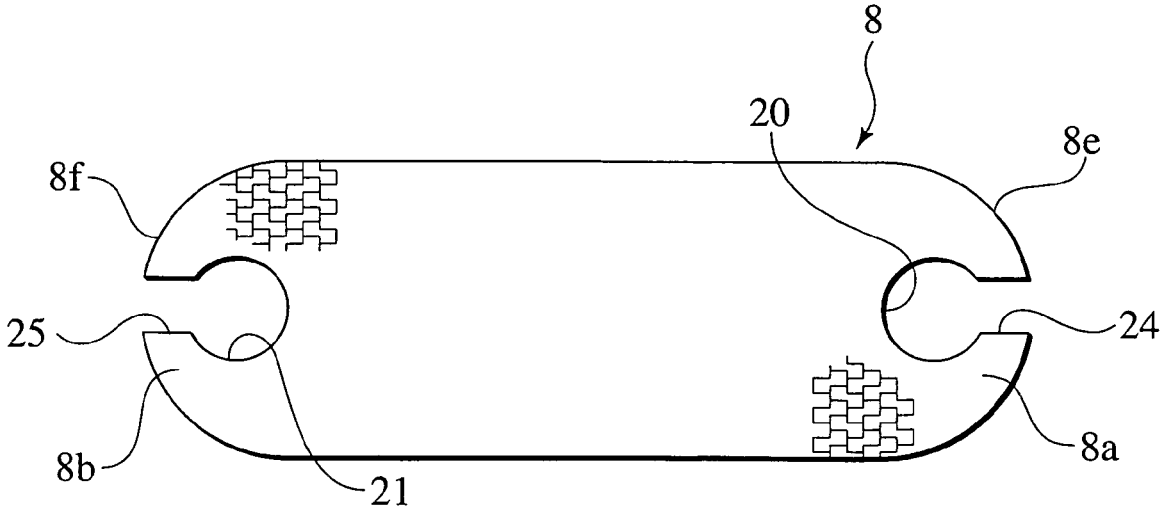
FIG. 12 is a plan view of a fin in the fifth modification of the embodiment.

In the modification of FIG. 12, an oblong fin 8 is provided, at both ends 8*a*, 8*b* in the longitudinal direction, with circular openings 20, 21 and cutout parts 24, 25 connecting the openings 20, 21 with the edges 8*e*, 8*f*, respectively. As shown in FIG. 12, the cutout parts 24, 25 are formed so as to extend from the openings 20, 21 to the edges 8*e*, 8*f* outwardly in the longitudinal direction of the fin 8. Owing to the formation of the cutout parts 24, 25, it becomes possible to make the fluid flow from the edge 8*e* to the edge 8*f*, whereby the heat exchange can be accomplished at both ends 8*a*, 8*b* of the fin 9.

Finally, it will be understood by those skilled in the art that the foregoing descriptions are nothing but three embodiments of the disclosed heat exchanger and therefore, various changes and modifications may be made within the scope of claims.

What is claimed is:

1. A heat exchanger comprising:

a plate-shaped heat exchanger unit shaped to be substantially rectangular in plan view, the plate-shaped heat exchanger unit having a first planar fluid communication chamber defined therein; and a flat fin shaped similarly to the first planar fluid communication chamber and accommodated in the first planar fluid communication chamber, the flat fin having a first end provided with a first recess and a second end opposing to the first end and provided with a second recess, wherein the first recess comprises a first circular opening formed in a vicinity of an edge of the first end and a first cutout part that extends from the first circular opening to the edge of the first end, and the second recess comprises a second circular opening formed in a vicinity of an edge of the second end and a second cutout part that extends from the second circular opening to the edge of the second end, thereby allowing a first fluid, which has been introduced into the first planar fluid communication chamber through the first recess, to flow along an edge of the first and second ends.

2. The heat exchanger of claim 1 wherein the flat fin is shaped so as to define a clearance between the first end and an inner periphery of the first planar fluid communication chamber, thereby allowing the first fluid, which has been introduced into the first planar fluid communication chamber through the first recess, to flow along an edge of the first end.

3. The heat exchanger of claim 2, wherein the flat fin is shaped so as to define another clearance between the second end and the inner periphery of the first planar fluid communication chamber.

4. The heat exchanger of claim 1, wherein the first opening and the second opening are arranged at two diagonal corners of the plate-shaped heat exchanger unit, respectively.

5. The heat exchanger of claim 1, wherein a shape of the first recess is substantially identical to a shape of the second recess.

6. The heat exchanger of claim 1, wherein the first cutout part has its width substantially equal to a diameter of the first circular opening, while the second cutout part has its width substantially equal to a diameter of the second circular opening.

7. The heat exchanger of claim 1, wherein tbc plate-shaped heat exchanger unit has a second planar fluid communication chamber defined therein for a second fluid different from the first fluid.

* * * * *